US010966899B2

(12) United States Patent
Ode

(10) Patent No.: US 10,966,899 B2
(45) Date of Patent: Apr. 6, 2021

(54) AIR MASSAGE DEVICE

(71) Applicant: FUJI MEDICAL INSTRUMENTS MFG. CO., LTD., Osaka (JP)

(72) Inventor: Kentaro Ode, Osaka (JP)

(73) Assignee: FUJI MEDICAL INSTRUMENTS MFG. CO., LTD., Osaka (JP)

( * ) Notice: Subject to any disclaimer, the term of this patent is extended or adjusted under 35 U.S.C. 154(b) by 1046 days.

(21) Appl. No.: 15/241,020

(22) Filed: Aug. 18, 2016

(65) Prior Publication Data

US 2017/0056280 A1 Mar. 2, 2017

(30) Foreign Application Priority Data

Aug. 25, 2015 (JP) ..... JP2015-165769

(51) Int. Cl.
*A61H 9/00* (2006.01)

(52) U.S. Cl.
CPC ... *A61H 9/0078* (2013.01); *A61H 2201/0149* (2013.01); *A61H 2201/0161* (2013.01); *A61H 2201/1207* (2013.01); *A61H 2201/164* (2013.01); *A61H 2201/1623* (2013.01); *A61H 2201/1635* (2013.01); *A61H 2201/5002* (2013.01); *A61H 2201/5005* (2013.01);
(Continued)

(58) Field of Classification Search
CPC ..... A61H 9/0078; A61H 2015/0042; A61H 2201/5002; A61H 2201/1628; A61H 2201/5087; A61H 2201/1207; A61H 2201/1623; A61H 2201/501; A61H 2015/0014; A61H 2201/5035; A61H 2201/0149; A61H 2201/1614; A47C 27/081; A47C 27/082; A47C 27/084; A47C 27/00; A47G 9/10; A61G 13/1265
See application file for complete search history.

(56) References Cited

U.S. PATENT DOCUMENTS 5,792,082 A * 8/1998 Yamanaka ..... A61H 9/0078 601/148
6,312,400 B1 * 11/2001 Itikawa ..... A61H 7/004 601/100
(Continued)

FOREIGN PATENT DOCUMENTS

CN 103705372 A 4/2014
JP 2001-054544 A 2/2001
(Continued)

OTHER PUBLICATIONS

Japan Patent Office; Examiner Kobayashi, Office Action dated Jul. 23, 2019 issued in corresponding Japanese Patent Application No. 2015-165769, total 9 pages.
(Continued)

*Primary Examiner* — Tu A Vo
(74) *Attorney, Agent, or Firm* — Masuvalley & Partners

(57) ABSTRACT

Provide is an air massage device including a plurality of air bags; an air pump 31 for supplying air into each of the air bags; solenoid valves 32 for switching on-off of air supply into each of the air bags; and a control part for changing an electric input value into the air pump 31 and an amount of the supplied air into each of the air bags per unit time to open and close each of the solenoid valves 32 so as to correspond to this change of the amount of the supplied air.

5 Claims, 15 Drawing Sheets

(52) U.S. Cl.
CPC ..... *A61H 2201/5007* (2013.01); *A61H 2201/5012* (2013.01); *A61H 2201/5015* (2013.01); *A61H 2201/5038* (2013.01)

(56) References Cited

U.S. PATENT DOCUMENTS 6,491,652 B1 * 12/2002 Hata ..... A61H 9/0078 601/148
6,592,533 B1 * 7/2003 Yonekawa ..... A47C 4/54 601/148
8,182,437 B2 * 5/2012 Gasbarro ..... A61H 9/0078 137/884
2001/0004679 A1 * 6/2001 Ichikawa ..... A61H 9/0078 601/98
2004/0097854 A1 * 5/2004 Hester ..... A61H 23/04 601/149
2005/0033204 A1 * 2/2005 Nakamura ..... A61H 23/04 601/103
2005/0159690 A1 * 7/2005 Barak ..... A61H 9/0078 601/149
2005/0187500 A1 * 8/2005 Perry ..... A61H 9/0078 601/152
2005/0288612 A1 * 12/2005 Suzuki ..... A61H 1/0266 601/151
2006/0036202 A1 * 2/2006 Iwata ..... A61H 9/0078 601/88
2006/0142676 A1 * 6/2006 Fujii ..... A61H 15/0078 601/98
2006/0155197 A1 * 7/2006 Kishimoto ..... F16K 31/02 600/498
2006/0217643 A1 * 9/2006 Yonekawa ..... A61H 9/0078 601/148
2007/0016119 A1 * 1/2007 Inada ..... A61H 9/0078 601/151
2007/0273180 A1 * 11/2007 Tanizawa ..... A47C 1/02 297/85 M
2007/0273187 A1 * 11/2007 Tanizawa ..... A61H 9/0078 297/217.3
2008/0048475 A1 * 2/2008 Tanizawa ..... A61H 23/04 297/284.6
2008/0243040 A1 * 10/2008 Kuwabara ..... A61H 1/00 601/149
2009/0036809 A1 * 2/2009 Nishio ..... A61H 15/0078 601/134
2009/0099489 A1 * 4/2009 Tanizawa ..... A61H 9/0078 601/84
2009/0177128 A1 * 7/2009 Fukuyama ..... A61H 15/0078 601/98
2009/0270782 A1 * 10/2009 Shimizu ..... A61H 1/0292 601/148
2009/0306555 A1 * 12/2009 Goto ..... A61H 5/00 601/15
2010/0031449 A1 * 2/2010 Cheng ..... B60N 2/976 5/713
2010/0145245 A1 * 6/2010 Chen ..... A61H 9/0078 601/149
2010/0207438 A1 * 8/2010 Inoue ..... A61H 1/0244 297/284.2
2010/0244520 A1 * 9/2010 Inoue ..... A61H 9/0078 297/284.2
2010/0312155 A1 * 12/2010 Fukuyama ..... A61H 9/0078 601/98
2011/0015554 A1 * 1/2011 Morikawa ..... A61H 1/0292 601/84
2012/0016274 A1 * 1/2012 Howe ..... A61H 9/0007 601/15
2012/0157898 A1 * 6/2012 Watanabe ..... A61H 9/0078 601/148
2012/0157899 A1 * 6/2012 Terada ..... A61H 9/0078 601/149
2014/0094726 A1 * 4/2014 Malhi ..... A61F 13/08 601/152
2014/0336552 A1 * 11/2014 Varga, Jr. ..... A61H 9/0007 601/149
2015/0374571 A1 * 12/2015 Denson ..... A61H 1/008 601/150
2016/0058654 A1 * 3/2016 Denson ..... A61H 9/0078 601/150

FOREIGN PATENT DOCUMENTS

JP 2001-149431 A 6/2001
JP 2004-216029 A 8/2004
JP 2005-046214 A 2/2005
JP 3709415 B2 10/2005
JP 2005-349138 A 12/2005
JP 2009-045416 A 3/2009
JP 2010-035818 A 2/2010

OTHER PUBLICATIONS

JPO, Notice of Rejection dated Dec. 18, 2018 in Japanese Patent Application No. 2015-165769, total 6 pages with English translation.
Reconsideration Report by Examiner before Appeal dated Nov. 15, 2019 in Japanese Application No. 2015-165769, 7 pages with translation.
Chinese Office Action dated Apr. 22, 2020 in Chinese Application No. 201610570549.3, Total 10 pages with translation.

* cited by examiner

AIR MASSAGE DEVICE

This application claims priority under 35 U.S.C. § 119 to Japanese patent application Serial No. 2015-165769, filed Aug. 25, 2015, which is incorporated herein by reference in its entirety.

FIELD OF INVENTION

The present invention relates to air massage device for performing treatment on a human body by utilizing a plurality of air bags which can be expanded and contracted, more specifically, an air massage device which can perform a variety of treatment.

BACKGROUND OF THE INVENTION

An air massage device performs treatment by pushing an expanded air bag onto a human body to press or grip the human body with only the air bag or in cooperation with a mechanical structure which can massage the human body or which is used for pivotal movement or the like. Although an expansion of the air bag is performed by supplying air into the air bag from an air pump, air supply performance of the air pump is constant. Namely, an amount of the supplied air per unit time is constant, thus the expansion of the air bag is performed at a certain constant speed.

Thus, a massage mode with the air bag is set depending on a tempo of the expansion and contraction of the air bag, an expansion and contraction time of the air bag, a size of the air bag and the like. For example, in the treatment with the air bag, it is impossible to slowly press the human body as required.

In terms of downsizing the air massage device or the like, it is unrealistic that the air massage device includes a plurality of air pumps. In addition, since discharging performance of the air pump is regulated, an expansion mode of the air bag connected to the air pump is inevitably determined. Thus, it is impossible to slowly expand the air bag as required, for example.

SUMMARY OF THE INVENTION

An air massage device includes a plurality of air bags; an air pump for supplying air into each of the air bags; air supply valves for switching on-off of air supply into each of the air bags; and a control part for changing an amount of the supplied air into each of the air bags per unit time according to an electric input value into the air pump to open and close each of the air supply valves so as to correspond to the amount of the supplied air.

DETAILED DESCRIPTION OF THE PREFERRED EMBODIMENT

Description will be given to one embodiment for practicing the present invention with reference to the accompanying drawings.

Figure 1:
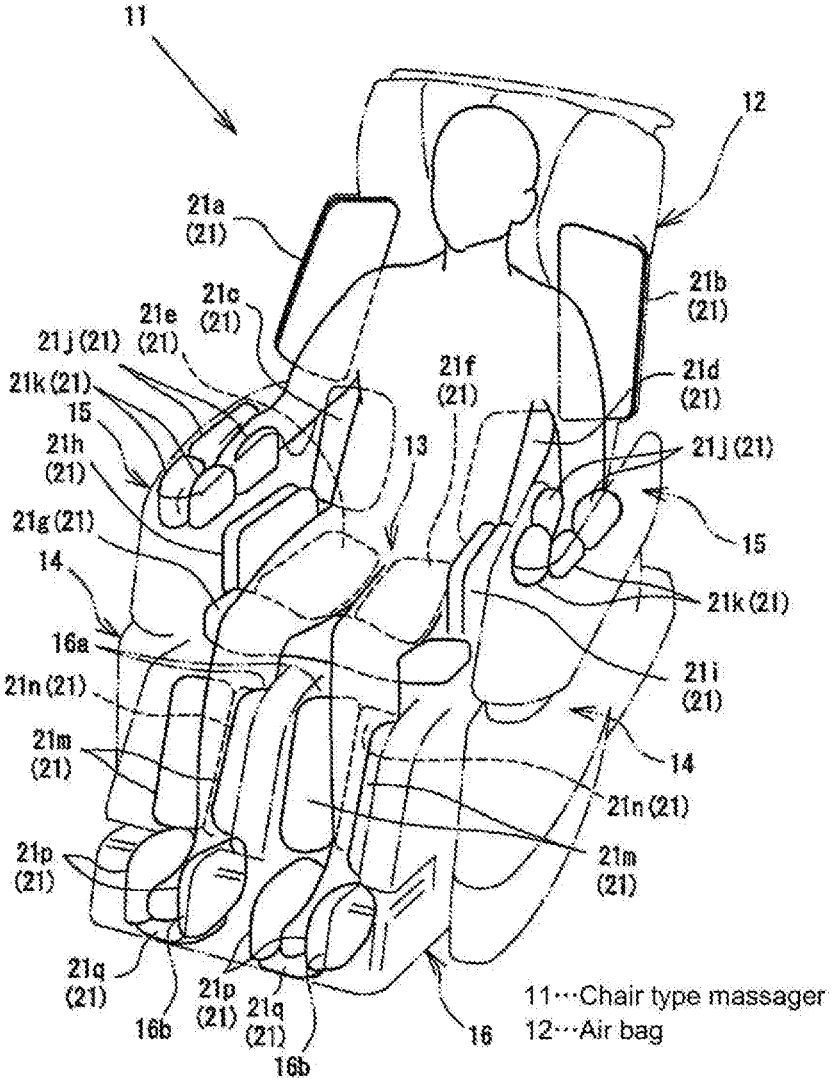
FIG. 1 is a perspective view of a schematic structure of a chair type massager.
Figure 2:
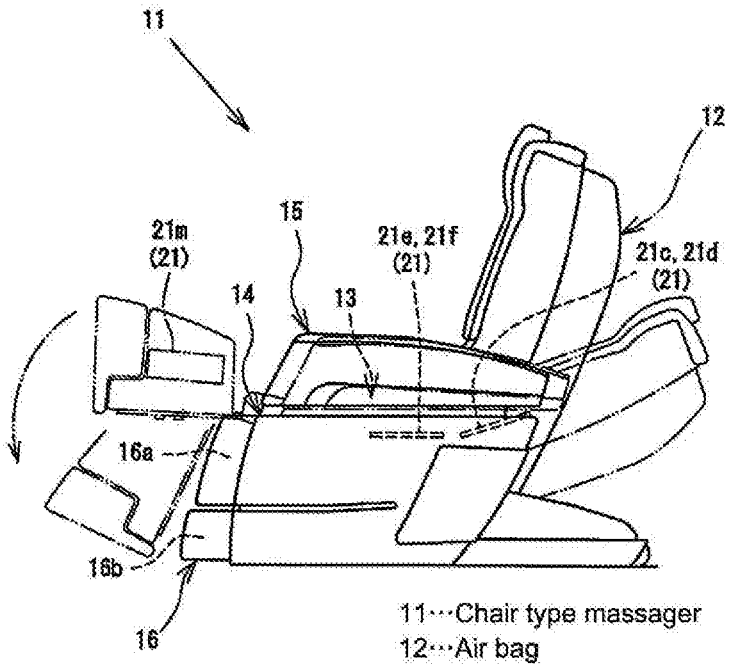
FIG. 2 is a side view of the chair type massager.

FIG. 1 is a perspective view of a schematic structure for mainly illustrating air bags 21 of a chair type massager 11 (hereinafter, referred to as "massager") as one example of an air massage device, and FIG. 2 is a side view thereof.

Figure 3:
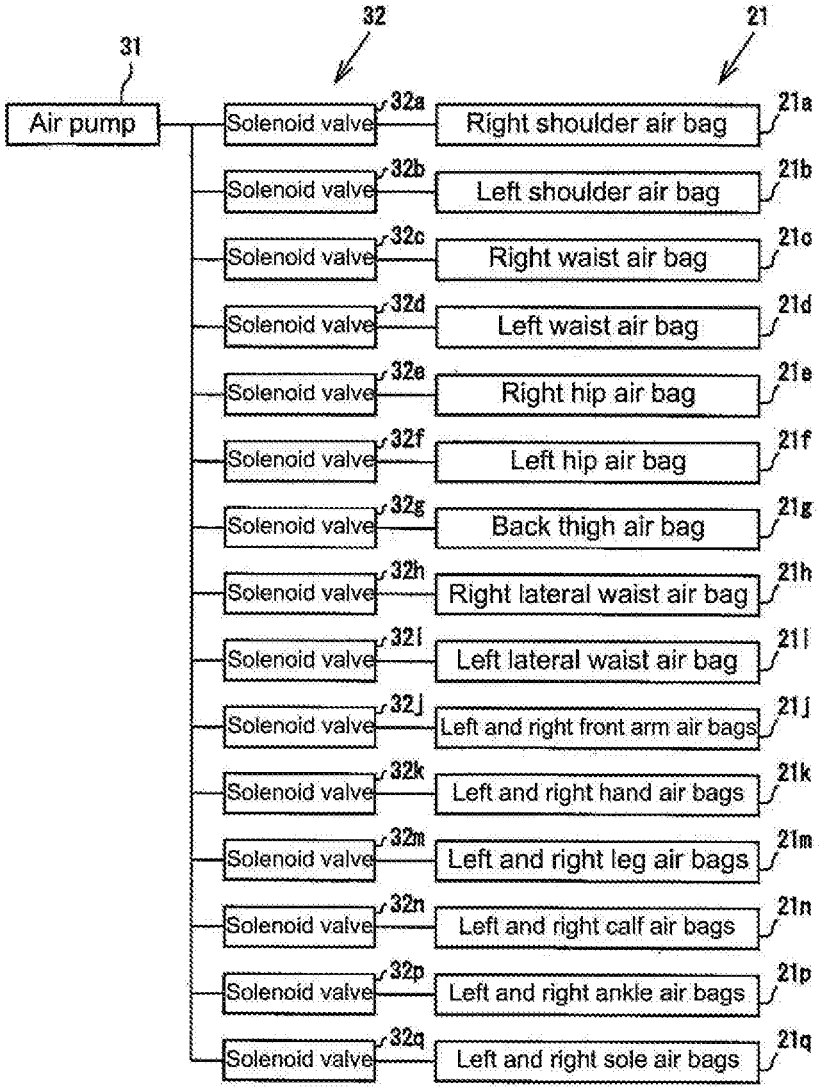
FIG. 3 is an air circuit block diagram from an air pump to air bags.

This massager 11 has a backrest part 12 which can be reclined toward the rear side, a seat part 13 extending from a lower end portion of the backrest part 12 toward the front side, armrest parts 14 standing on both left and right sides of the seat part 13, arm receiving parts 15 respectively provided on upper ends of the armrest parts 14 provided on the left and right sides and a rotatable ottoman 16 provided on the front and lower side of the seat part 13. Further, as shown in FIG. 3, a plurality of air bags 21 which can be expanded and contracted are respectively provided on these parts.

Each of the air bags 21 has a flattened form when the air bag 21 is contracted. When each of the air bags 21 is appropriately expanded, each of the air bags 21 presses a contacting part to add a stimulus to the contacting part, grip the contacting part or push the contacting part. The words of "contacting part" may be a human body, a part of the massager or another air bag 21.

In the backrest part 12, a mechanical unit (not shown in the drawings) for massaging a shoulder or a back of the human body is embedded and air bags 21 (a right shoulder air bag 21*a* and a left shoulder air bag 21*b*) are respectively provided at portions corresponding to both shoulders of the human body. Each of these air bags 21 (the right shoulder air bag 21*a* and the left shoulder air bag 21*b*) is provided so that three air bag carriers are overlapped with each other and contained in a cover (not shown in the drawings) in a state that lower ends thereof are held. In this regard, even in the case where the three air bag carriers are overlapped, the number of an air supply port (not shown in the drawings) for the air bags 21 is one. Air rooms inside the air bag carriers are communicated with each other. Since the three air bag carriers are overlapped, it is possible to obtain a sufficient expansion stroke in a direction perpendicular to a surface direction of the air bag 21, thereby effectively pressing.

The backrest part 12 further includes air bags 21 (a right waist air bag 21*c* and a left waist air bag 21*d*) at portions corresponding to both sides of a waist of the human body.

The backrest part 12 having such a configuration is supported by a backrest pivot actuator (not shown in the drawings) so that the backrest part 12 can be reclined.

The seat part 13 is a part for supporting a hip and thighs of the human body, that is a part between the waist and knees. Air bags 21 (a right hip air bag 21*e* and a left hip air bag 21*f*) are provided at portions of an upper surface of the seat part 13 on which both sides of the hip and parts of the thighs are to be placed. One air bag 21 (a back thigh air bag 21*g*) having an elongated shape in the side direction is provided at a portion on which lower parts of the thighs are to be placed in the front side of these air bags 21 (the right hip air bag 21*e* and the left hip air bag 21*f*).

Air bags 21 (a right lateral waist air bag 21*h* and a left lateral waist air bag 21*i*) for pressing a part from the thighs to an outer lateral part of the waist of the human body are respectively provided at portions on both left and right lateral sides of such a seat part 13, in other words, at portions of the armrest parts 14 on the both left and right sides. Each of these air bags 21 (the right lateral waist air bag 21*h* and the left lateral waist air bag 21*i*) is provided so that two air bag carriers are overlapped with each other and contained in a cover (not shown in the drawings) in a state that lower ends thereof are held.

In this regard, even in the case where the two air bag carriers are overlapped, the number of an air supply port (not shown in the drawings) for the air bags 21 is one. Air rooms inside the air bag carriers are communicated with each other. Since the two air bag carriers are overlapped, it is possible to obtain a sufficient expansion stroke in a direction perpendicular to a surface direction of the air bag 21, thereby effectively pressing.

Each of the arm receiving parts 15 has an open space on the upper side thereof. Further, a shape of each of the arm receiving parts 15 in a vertical cross-sectional view thereof is a substantially U-like shape. In an internal space of each of the arm receiving parts 15, air bags 21 (left and right front arm air bags 21*j* and left and right hand air bags 21*k*) for pressing an arm and a hand of the human body are provided so as to face to each other and grip the arm and the hand.

The ottoman 16 has a pair of lower thigh receiving parts 16*a* for receiving left and right lower thighs of the human body and a pair of foot receiving parts 16*b* for receiving left and right feet of the human body. Each of the lower thigh receiving part 16*a* and the foot receiving part 16*b* has a groove-like shape.

Portions on which the foot receiving parts 16*b* are provided can be approached to or separated from portions on which the lower thigh receiving parts 16*a* are provided. The ottoman 16 is configured to be capable of adjusting a length of the ottoman 16 so as to adapt to the human body by pushing the portions on which the foot receiving parts 16*b* are provided with legs against biasing force. The ottoman 16 having such a configuration is supported by an ottoman pivot actuator (not shown in the drawings) so that the ottoman 16 can be pivotally moved toward a direction in which the ottoman 16 springs up.

A pair of air bags 21 (left and right leg air bags 21*m*) for pressing left and right sides of the lower thigh is respectively provided on the both lateral sides of each of the lower thigh receiving parts 16*a* of the ottoman 16. Air bags 21 (left and right calf air bags 21*n*) for pressing back sides of the left and right lower thighs, that is for pressing calves are provided between these air bags 21 (left and right leg air bags 21*m*), that is at a groove bottom portion between the both lateral sides of each of the lower thigh receiving parts 16*a*.

A pair of air bags 21 (left and right ankle air bags 21*p*) for pressing a front side part of each of left and right feet is provided in each of the foot receiving parts 16*b* of the ottoman 16. Further, air bags 21 (left and right sole air bags 21*q*) for pressing back sides of the left and right feet are respectively provided at groove bottom parts between both lateral sides of the foot receiving parts 16*b*.

Figure 4:
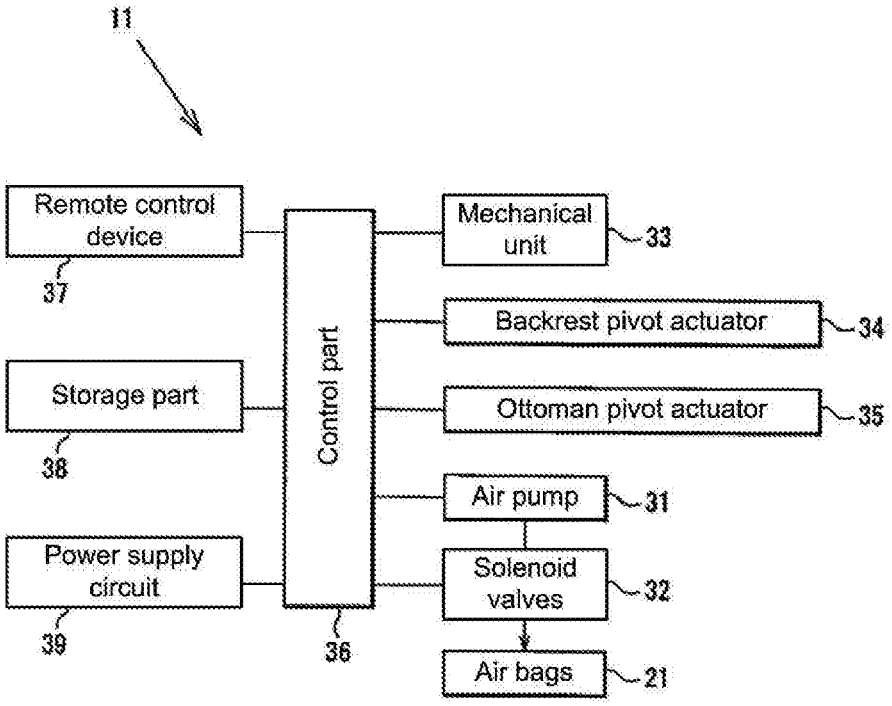
FIG. 4 is a control circuit block diagram of the chair type massager.

In order to expand and contract these air bags 21, as shown in FIG. 3 and FIG. 4, the massager 11 has an air pump 31 for supplying air into each of the air bags 21 and solenoid valves 32 acting as air supply valves for switching on-off of air supply into each of the air bags 21. Further, the air pump 31 and the solenoid valves 32 are driven and controlled together with a mechanical unit 33, a backrest pivot actuator 34 and an ottoman pivot actuator 35 by a control part 36 constituted of a microcomputer and the like.

The air pump 31 includes a motor (not show in the drawings) constituting a part of the air pump 31 and driven by, for example, 24 V of DC voltage. A rotational number of the motor can be changed by changing an electric input value, that is voltage and/or current. Thus, the air pump 31 is configured to be capable of changing an amount of supplied air into each of the air bags 21 per unit time. Strength of pressing or gripping due to the air bag 21 (for example, "strong", "medium", "weak", "1", "2", "3", "4" and "5") is determined by the amount of the supplied air from the air pump 31 per unit time and a time duration from the time of starting to supply the air into each of the air bags 21 to the time of stopping supplying the air, that is a time duration while each of the solenoid valves 32 is opened.

A remote control device 37 for inputting an operational signal, a storage part 38 for storing necessary information such as a treatment operation pattern and a treatment course operation, a power supply circuit 39 for supplying electric power and the like are connected to the control part 36. The control part 36 performs an operation for each component such as the air pump 31 and the solenoid valves 32 according to an input from the remote control device 37 and a program preliminary stored.

A connecting condition among the air pump 31, the solenoid valves 32 and the air bags 21 is illustrated in FIG. 3. Namely, the connecting condition is configured so that the solenoid valves 32 for each unit air bag 21 are respectively provided between the one air pump 31 and the described plurality of air bags 21 and each unit air bag 21 can be independently expanded or contracted.

Specifically, the right shoulder air bag 21*a*, the left shoulder air bag 21*b*, the right waist air bag 21*c*, the left waist air bag 21*d*, the right hip air bag 21*e*, the left hip air bag 21*f*, the back thigh air bag 21*g*, the right lateral waist air bag 21*h*, the left lateral waist air bag 21*i*, the left and right front arm air bags 21*j*, the left and right hand air bags 21*k*, the left and right leg air bags 21*m*, the left and right calf air bags 21*n*, the left and right ankle air bags 21*p* and the left and right sole air bags 21*q* are the unit air bags 21. For each unit air bag 21, each of solenoid valves 32*a*, 32*b*, 32*c*, 32*d*, 32*e*, 32*f*, 32*g*, 32*h*, 32*i*, 32*j*, 32*k*, 32*m*, 32*n*, 32*p*, 32*q* is provided. The connecting condition illustrated in FIG. 4 is one example, thus it is possible to take another connecting condition.

The control part 36 inputs and outputs signals or necessary information. Among others, the control part 36 changes the electric input value into the air pump 31 to change the amount of the supplied air into each of the air bags 21 per unit time and opens and closes the solenoid valves 32 depending on this change of the amount of the supplied air.

Next, description will be given to an example of a control operation performed by the control part 36 of the massager 11 configured as described above.

<Example 1> The Case where a Treatment Course with a Slow Mode is Provided in a Plurality of Treatment Courses The storage part 38 of the massager stores a plurality of treatment courses such as "fatigue recovering course", "refresh course", "calmness course" and "stretch course" obtained by combining a variety of treatment operations. In addition, the storage part 38 is configured to be capable of storing treatment operations meeting user's taste as a "memory course", for example.

In the conventional art, the air supply due to the air pump in these treatment courses is performed in a state that the electric input value into the air pump is sufficiently increased, that is in a normal mode. The described control part 36 enables the solenoid valves 32 to be opened and closed according to a plurality of predetermined treatment courses and enables the massager to perform treatment operations due to the treatment course in the slow mode, in which the electric input value into the air pump 31 is decreased so as to be lower than the electric input value of the normal mode to elongate an air supply time duration, in addition to the treatment course in the normal mode in which the electric input value into the air pump 31 is sufficiently increased.

Figure 5:
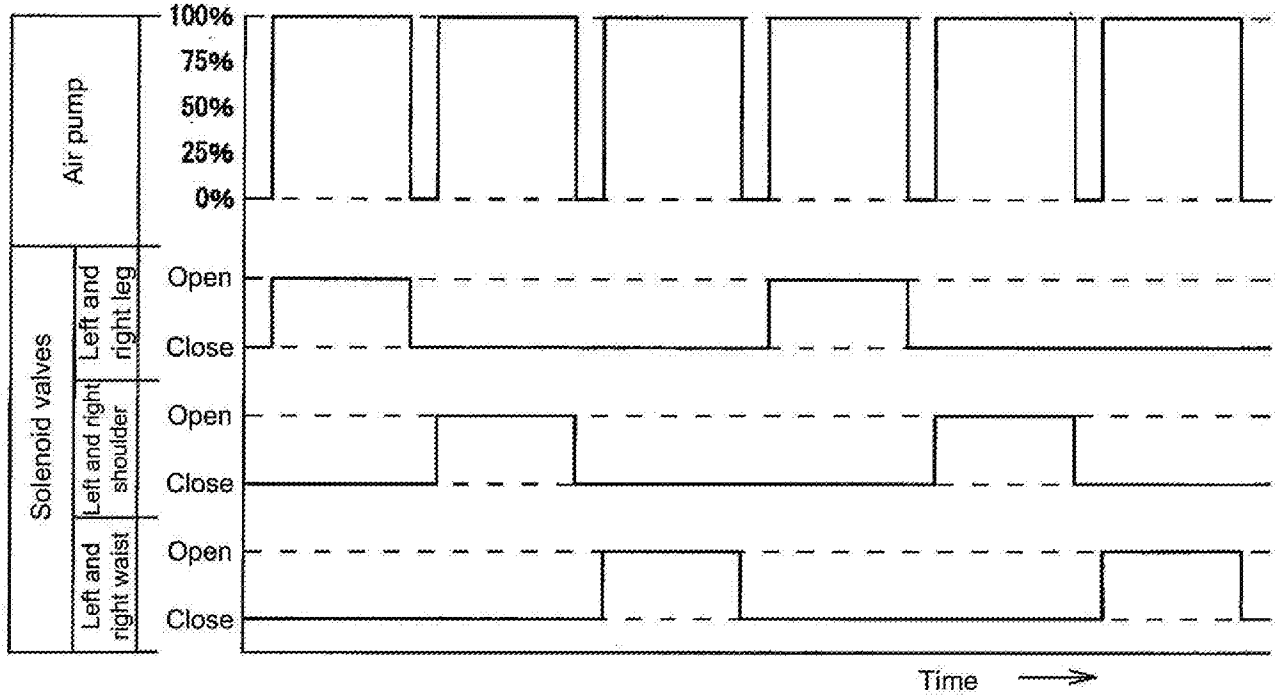
FIG. 5 is time charts for the air pump and the solenoid valves in a normal mode in example 1.

The above words of "state that the electric input value is sufficiently increased" means a state that voltage and/or current are increased to provide 100% of air supply performance of the air pump 31 or provide a slightly lower performance than 100% (for example, 85%) of the air supply performance of the air pump 31, for example, as shown in FIG. 5. Although this state has a little flexible range, this state means a state that 80% or more of the air supply performance is provided.

The treatment operations due to the treatment course in the normal mode are performed in the following manner.

As shown in FIG. 5, the control part 36 intermittently drives the air pump 31 according to treatment course information preliminarily stored in the storage part 38 in a state that the electric input value is sufficiently increased. Further, at the same time of driving the air pump 31, the control part 36 opens and closes, for example, each of the solenoid valves 32*m*, 32*a*, 32*b*, 32*c*, 32*d* respectively connected to the left and right leg air bags 21*m*, the right shoulder air bag 21*a*, the left shoulder air bag 21*b*, the right waist air bag 21*c* and the left waist air bag 21*d* according to the treatment course information preliminarily stored in the storage part 38. With this configuration, the left and right leg air bags 21*m*, the right shoulder air bag 21*a*, the left shoulder air bag 21*b*, the right waist air bag 21*c* and the left waist air bag 21*d* are expanded and contracted in turn at a predetermined tempo. Although expanding speeds of the air bags 21 may differ from each other depending on sizes of the air bags 21, the expanding speeds of the air bags 21 are basically equal to each other. The expanding speeds of the air bags 21 are a speed having swiftness which can sufficiently exhibit the air supply performance of the air pump 31.

In order to perform the treatment operations due to the treatment course in the slow mode, the control part 36 stores necessary information such as air supply performance information of the air pump 31 used for decreasing the electric input value to elongate an air supply time duration, electric input value information corresponding to the air supply performance information, time information indicating time required for obtaining a desired expanding condition, timing information for opening and closing each of the solenoid valves 32 respectively connected to the air bags 21 so as to correspond to driving timing for the air pump 31.

The treatment operations due to the treatment course in the slow mode are performed in the following manner as is the case for the normal mode.

Figure 6:
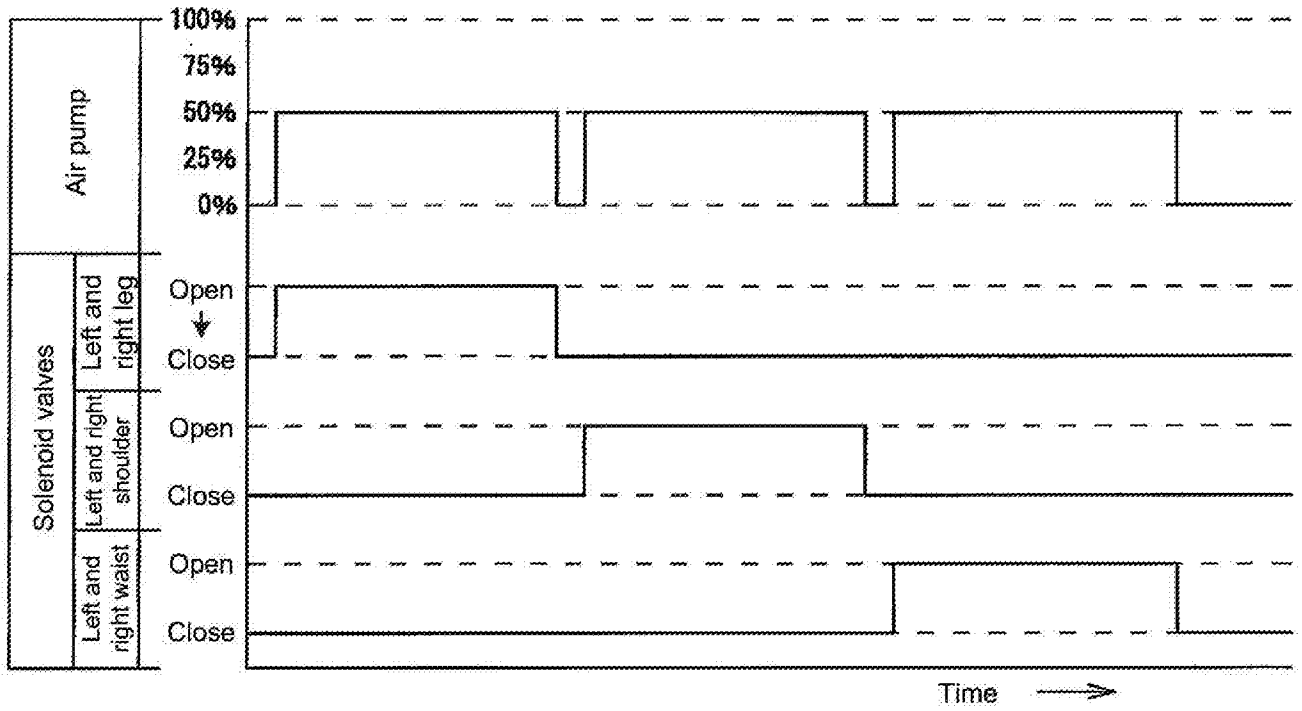
FIG. 6 is time charts for the air pump and the solenoid valves in a slow mode in the example 1.

As shown in FIG. 6, the control part 36 intermittently drives the air pump 31 according to the treatment course information preliminarily stored in the storage part 38 in a state that, for example, 50% of the air supply performance of the air pump 31 is provided. Further, at the same time of driving the air pump 31, the control part 36 opens and closes, for example, each of the solenoid valves 32*m*, 32*a*, 32*b*, 32*c*, 32*d* respectively connected to the left and right leg air bags 21*m*, the right shoulder air bag 21*a*, the left shoulder air bag 21*b*, the right waist air bag 21*c* and the left waist air bag 21*d* according to the treatment course information preliminarily stored in the storage part 38. With this configuration, the left and right leg air bags 21*m*, the right shoulder air bag 21*a*, the left shoulder air bag 21*b*, the right waist air bag 21*c* and the left waist air bag 21*d* are expanded and contracted in turn at a predetermined tempo. The expanding speeds of the air bags 21 are slow and slower than these of the normal mode.

Figure 7:
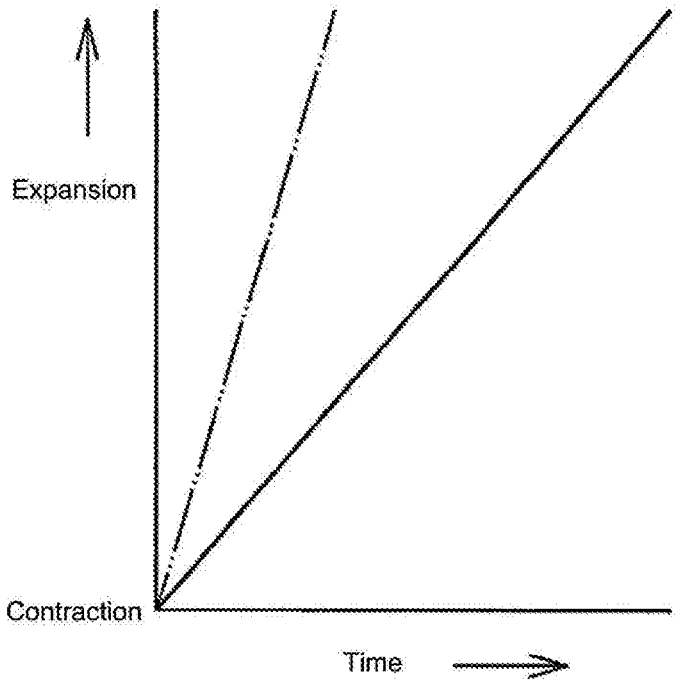
FIG. 7 is an explanatory drawing for illustrating expansion modes in the normal mode and the slow mode.

When the expanding speeds of the air bags 21 in the treatment course in the normal mode and the slow mode are compared with each other, the air bags 21 in the normal mode are expanded in a short time as represented by an imaginary line (two-dot chain line) in FIG. 7. In contrast, the air bags 21 in the slow mode are slowly expanded in a longer time than the case of the normal mode as represented by a solid line in FIG. 7. Thus, in the slow mode, it is possible to softly and carefully press the contacting part of the human body or the like. In the case where the treatment course in the slow mode is performed in the same time as the treatment course in the normal mode, although the number of pressing or gripping the human body decreases, it is possible to provide a slow and kind massage. A course time length of the treatment course in the slow mode may be longer than that of the normal mode.

The air supply performance (%) of the air pump 31 may be appropriately set depending on the type of the treatment course or the like. Further, it may be possible to take a configuration in which some kinds of the air supply performance can be selected. In this case, it is preferable that the modes are not represented by "normal mode" and "slow mode" as described above but are represented by "slow mode", "normal mode" and "quick mode" or "speed 1", "speed 2" . . . depending on the number of the kinds.

As described above, it is possible to perform a variety of treatment. In addition, since the number of the air pump 31 included in the massager may be one, the massager has sufficient property in terms of space-saving and a production cost.

Furthermore, since the air supply performance of the air pump 31 is changed to vary the expanding conditions of the air bags 21, the massager has an advantage of simplifying a wiring structure of pipes or the like compared with the case where some kinds of air pumps which can respectively provide predetermined different air supply performances are used. Further, it is possible to perform a variety of treatment as a whole.

<Example 2> The Case where the Treatment Operations in the Slow Mode are Provided in One Treatment Course A part having the same treatment operations as these of the described slow mode is incorporated into at least one of the plurality of treatment course information to be stored in the storage part 38 of the massager 11. Namely, in the treatment operations in one treatment course among the plurality of predetermined treatment courses, at least a normal operation in which the electric input value into the air pump 31 is sufficiently increased and a slow operation in which the electric input value is decreased so as to be lower than the electric input value of the normal operation to elongate the air supply time duration are automatically performed.

This configuration is preferable, for example, in the case where warming-up is performed after starting the treatment course and the case where cooling-down is performed before the treatment course ends.

The storage part 38 of the massager 11 stores the plurality of treatment course information, electric input value information corresponding to the air supply performance of the air pump 31 in the normal mode in one treatment course information among the plurality of treatment course information, electric input value information corresponding to the air supply performance of the air pump 31 in the slow mode, timing information and time information for driving the air pump 31 in each mode, solenoid valve information for the solenoid valves to be switched and opening and closing timing information for the solenoid valves. Each of the plurality of treatment course information has treatment operations suitable for warming-up and cooling-down respectively performed after the course starts and before the course ends.

The control part 36 drives the air pump 31 and the solenoid valves 32 based on the treatment course information stored in the storage part 38 to perform the treatment in the slow mode as described above for certain time durations after the treatment course starts and before the treatment course ends and perform the treatment in the normal mode as described above between these time durations.

As described above, in the treatment of the treatment course in which the slow mode is incorporated as a part of the treatment, since a slow treatment in addition to the normal treatment can be performed in one treatment course, it is possible to perform a variety of treatment.

In the case where the normal mode is performed in a state that, for example, 80% of the air supply performance of the air pump 31 is provided, it may be possible to set "a quick mode" in which the air supply performance of the air pump 31 is higher than that of the normal mode, for example, 100% of the air supply performance of the air pump 31 is provided.

<Example 3> The Case where the Treatment Operations in the Slow Mode can be Arbitrarily Performed in One Treatment Course Operation Since the strength of pressing and/or gripping due to the air bag 21 can be set as described above, the user can receive a plurality of treatment which are comfortable and match different purposes by appropriately adjusting the strength of pressing and/or gripping. In the same manner, in the case where the user feels that the expanding speed of the air bag 21 is too fast or too slow, the massager 11 is configured to appropriately adjust the expanding speed of the air bag 21 according to user's preference even while the treatment course is being performed.

Namely, in the treatment operations in one treatment course among the plurality of predetermined treatment courses, at least a normal operation in which the electric input value into the air pump 31 is sufficiently increased and a slow operation in which the electric input value is decreased so as to be lower than the electric input value of the normal operation to elongate the air supply time duration are arbitrarily performed.

For this purpose, the remote control device 37 includes a switch (not shown in the drawings) for switching among "slow mode", "normal mode" and "quick mode". If the normal mode provides the treatment in a state that, for example, 80% of the air supply performance of the air pump 31 is provided, the words of "quick mode" used herein mean a mode in which the air supply performance of the air pump 31 is higher than that of the normal mode, for example, 100% of the air supply performance of the air pump 31 is provided. Thus, in the case where the normal mode provides the treatment in a state that 100% of the air supply performance of the air pump 31 is provided, it is impossible to set the quick mode.

The storage part 38 of the massager 11 stores one treatment course information, electric input value information corresponding to the air supply performance of the air pump 31 in the normal mode in the one treatment course, electric input value information corresponding to the air supply performance of the air pump 31 in the slow mode, electric input value information corresponding to the air supply performance of the air pump 31 in the quick mode, timing information and time information for driving the air pump 31 in each mode, solenoid valve information for the solenoid valves to be switched and opening and closing timing information for the solenoid valves.

The control part 36 performs the treatment course operations in the normal mode based on the treatment course information stored in the storage part 38 at the beginning of the treatment course and waits for an input for "the slow mode" or "the quick mode" from the remote control device 37. Then, the control part 36 reads the electric input value information corresponding to the air supply performance of the pump in the slow mode or the electric input value information corresponding to the air supply performance of the pump in the quick mode from the storage part 38 according to the input from the remote control device 37 to transmit the electric input value information into the air pump 31.

At the same time, for the solenoid valves 32 required in the treatment course being performed, the control part 36 reads the opening and closing timing information for the solenoid valves 32 stored in the storage part 38 to perform comparison calculation for comparing the opening and closing timing information with information on the solenoid valves 32 being driven and controls opening times for the solenoid valves 32 according to this comparison result. With this configuration, the air supply performance of the air pump 31 is changed to perform the treatment in the slow mode or the quick mode. Depending on timing for an input of changing the mode, the control part 36 changes the opening and closing timing for the solenoid valves 32 as required for performing appropriate treatment.

As described above, according to the treatment which can appropriately incorporate the slow mode or the quick mode as required, it is possible to provide a more variety of treatment.

<Example 4> The Case where the Expansion in the Normal Mode and the Expansion in the Slow Mode are Applied on One Air Bag in One Treatment Operation in the Treatment Course The words of "one air bag" used herein mean one air bag 21 having one internal air room. Namely, even if three air bag carriers are overlapped with each other as is the case for the described right shoulder air bag 21*a* or the described left shoulder air bag 21*b* and if two air bag carriers are overlapped with each other as is the case for the described right lateral waist air bag 21*h* or the described left lateral waist air bag 21*i*, the number of the air room is one because the number of the air supply port is one and the air bag carriers are integrally connected with each other. Thus, these are also one air bag 21.

As one example of the treatment operations, "waist twisting" will be described.

The waist twisting is an operation for lifting up the waist and the hip on one side to twist the body. In the waist twisting, fast air supply is performed in the normal mode until the user is put into a posture for starting to twist the body and then the twisting is carefully performed in the slow mode. Namely, the electric input value into the air pump 31 is sufficiently increased until the one air bag 21 reaches a certain expanding condition and then the electric input value is decreased so as to be lower than that of the normal mode to elongate the air supply time duration, thereby slowly expanding the one air bag 21. The treatment performed in this mode is near to manual treatment.

The storage part 38 of the massager 11 stores electric input value information, timing information and time information for an operation in the normal mode in which the electric input value into the air pump 31 is sufficiently increased and an operation in the slow mode in which the electric input value into the air pump 31 is decreased so as to be lower than that of the normal mode as a "waist twisting" treatment operation. Further, timing information for opening and closing the solenoid valves 32*c*, 32*d*, 32*e*, 32*f* respectively connected to the right waist air bag 21*c*, the left waist air bag 21*d*, the right hip air bag 21*e* and the left hip air bag 21*f* is stored so as to correspond to the timing information and the time information for the operation in each mode.

Figure 8:
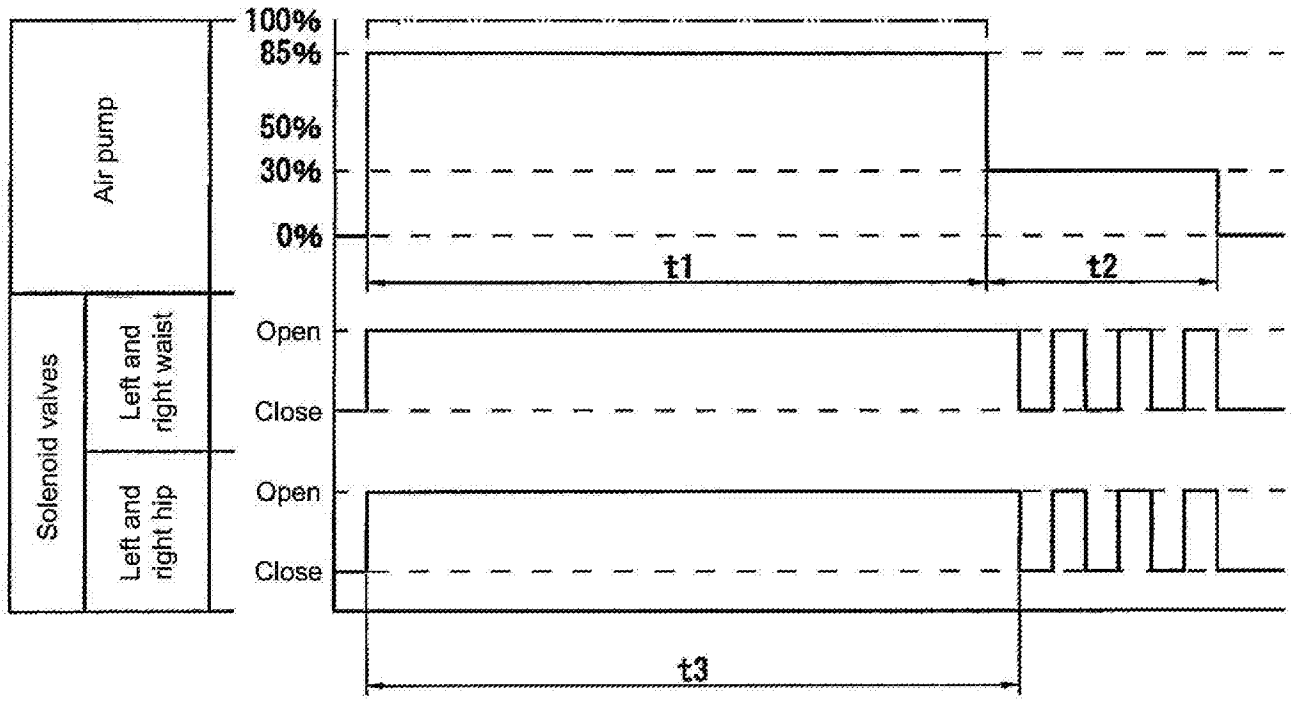
FIG. 8 is time charts for the air pump and the solenoid valves in a waist twisting treatment operation in example 4.

Specifically, as shown in FIG. 8, the timing information is set so that the operation of the air pump 31 in the normal mode is performed for a time duration t1 and then the operation in the slow mode is performed for a time duration t2. This is one cycle. Since the waist is twisted toward one side by one cycle, two cycles are performed in order to twist the waist toward both sides.

The opening and closing timing and time for the solenoid valves 32*d*, 32*f* respectively connected to the left waist air bag 21*d* and the left hip air bag 21*f* are equal to each other. The opening and closing timing and time for the solenoid valves 32*c*, 32*e* respectively connected to the right waist air bag 21*c* and the right hip air bag 21*e* are equal to each other.

These solenoid valves 32*d*, 32*f* or these solenoid valves 32*c*, 32*e* are opened at the same time of driving the air pump 31. An opening time duration t3 until the solenoid valves 32*d*, 32*f* or 32*c*, 32*e* are closed after they have been opened is set to be longer than the operation time duration t1 of the air pump 31 in the normal mode and shorter than a total time of the operation time duration t1 in the normal mode and the operation time duration t2 in the slow mode.

The solenoid valves 32*d*, 32*f* or the solenoid valves 32*c*, 32*e* are set so as to be repeatedly closed and opened after the opening time duration t3 has first passed. The solenoid valves 32*d*, 32*f* or the solenoid valves 32*c*, 32*e* may be set so as to discharge the air in the air bags 21 at the same time of closing the solenoid valves 32*d*, 32*f* or 32*c*, 32*e* or so as to keep the air without discharging the air.

The described operation time duration t1 of the air pump 31 in the normal mode is set to enable the left waist air bag 21*d* and the left hip air bag 21*f* or the right waist air bag 21*c* and the right hip air bag 21*e* to be expanded until the user is put into the posture for starting to twist the human body as described above, that is, until the air bags 21*d*, 21*f* or 21*c*, 21*e* are expanded to a predetermined size (a predetermined expansion) in which the air bags 21*d*, 21*f* or 21*c*, 21*e* make contact with the human body with a certain level of pressure. The predetermined expansion varies depending on conditions such as the sizes of the air bags 21. A condition of the predetermined expansion may be appropriately set by the storage part 38 and the control part 36.

When the "waist twisting" treatment operation is started, the control part 36 appropriately reads necessary information stored in the storage part 38 to enable the air pump 31 to drive in the normal mode. On the other hand, at the same time, the control part 36 outputs opening signals to the solenoid valves 32*d*, 32*f* or the solenoid valves 32*c*, 32*e* to start to expand the left waist air bag 21*d* and the left hip air bag 21*f* or the right waist air bag 21*c* and the right hip air bag 21*e*. When a predetermined time passes after that, the control part 36 reads the electric input value information in the slow mode from the storage part 38 to output it into the air pump 31 and decrease the electric input value into the air pump 31 for shifting the air pump 31 into the slow mode.

The expansions of the left waist air bag 21*d* and the left hip air bag 21*f* or the expansions of the right waist air bag 21*c* and the right hip air bag 21*e* are kept even after the air pump 31 shifts from the normal mode to the slow mode. Namely, as shown in FIG. 9, these expansions are performed with a normal speed until the air bags 21 are expanded to the predetermined expansion and then the air bags 21 are slowly expanded.

Figure 9:
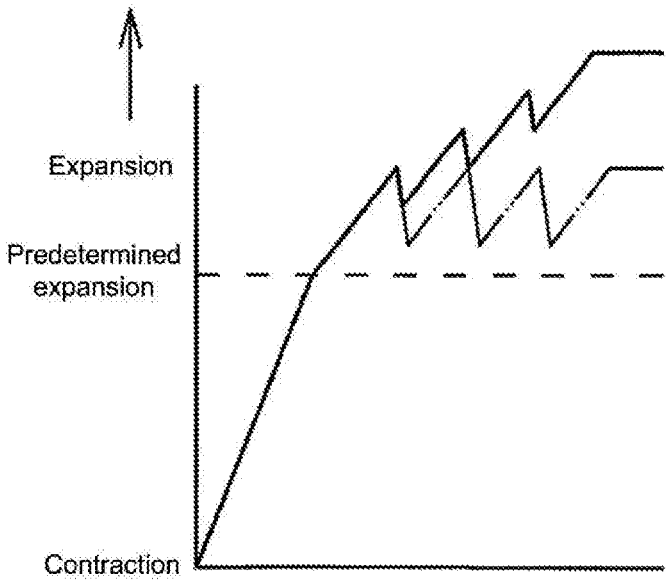
FIG. 9 is an explanatory drawing for illustrating expansion modes in the waist twisting treatment operation and a shoulder treatment operation.

After that, the control part 36 opens and closes the solenoid valves 32*d*, 32*f* or the solenoid valves 32*c*, 32*e* according to a predetermined mode to expand the air bags 21 in a phased manner (see a solid line in FIG. 9) or to repeatedly contract and expand the air bags 21 (see an imaginary line in FIG. 9). Since these expansions are performed in the slow mode, the treatment operation can be performed slowly and carefully as if the human body is pressed by human hands.

In the "waist twisting" treatment operation as described above, the air bags 21 are quickly expanded to the predetermined expansion before the treatment starts and then the subsequent treatment is slowly performed. Thus, it is possible to eliminate a time duration until the air bags 21 make contact with the human body with predetermined pressure, that is a blank time. From this view point, although the air supply performance of the air pump 31 in the operation in the normal mode shown in FIG. 8 is set to be 85%, it may be possible to set the air supply performance of the air pump 31 to be 100% as represented by the imaginary line in FIG. 8 to perform the operation in the quick mode for expanding the air bags 21 more quickly than the operation in the normal mode.

In addition to the effect that it is possible to eliminate the blank time, it is possible to perform the actual operations for pressing and gripping the human body slowly and carefully as if the human body is pressed and gripped by human hands. Thus, it is possible to perform a variety of treatment.

The "waist twisting" treatment operation as described above is set so as to be incorporated into a treatment course or be singularly utilized.

From the described view point that it is possible to eliminate the blank time, description will be next given to a treatment operation for shoulders as another example.

A shoulder treatment operation is an operation for pressing shoulders on the left and right sides so as to cover the shoulders from both arms to shoulder blades. Since a shoulder width has large differences among individuals, there is a case where a slight blank time exists until the shoulders are actually pressed and the user receives treatment feeling. In order to eliminate this blank time to perform efficient treatment, the solenoid valves 32*a*, 32*b* respectively connected to the right shoulder air bag 21*a* and the left shoulder air bag 21*b* are opened and closed in the same manner as the case described with reference to FIG. 8.

Figure 10:
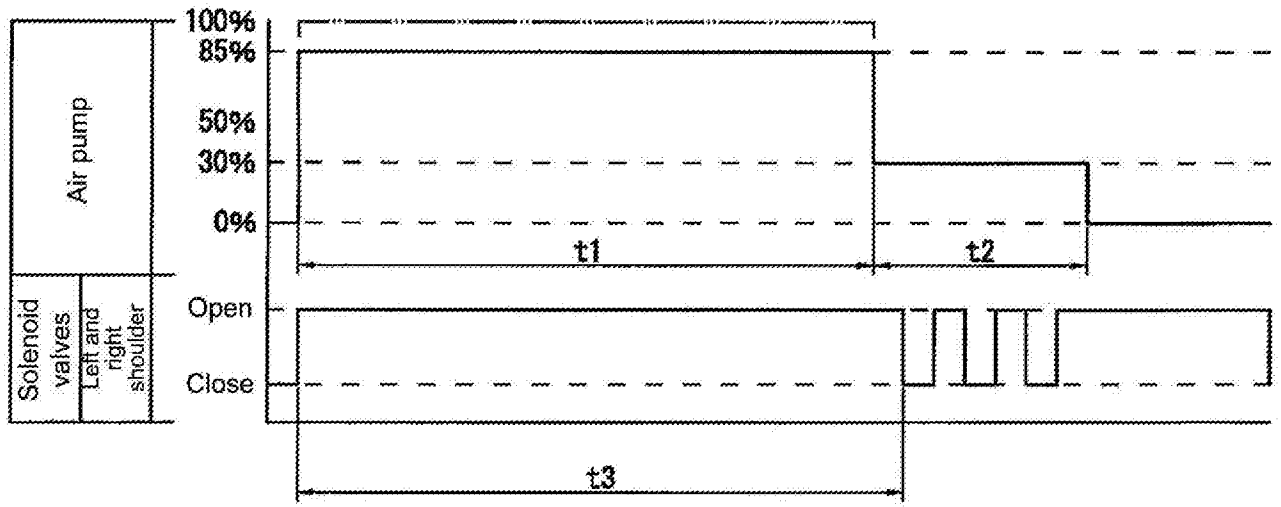
FIG. 10 is time charts for the air pump and the solenoid valves in the shoulder treatment operation in the example 4.

Namely, as shown in FIG. 10, the timing information is set so that the operation of the air pump 31 in the normal mode is performed for a time duration t1 and then the operation in the slow mode is performed for a time duration t2. This is one cycle.

Opening and closing timing and time for the solenoid valves 32*a*, 32*b* respectively connected to the right shoulder air bag 21*a* and the left shoulder air bag 21*b* are equal to each other. The solenoid valves 32*a*, 32*b* respectively connected to the right shoulder air bag 21*a* and the left shoulder air bag 21*b* are opened at the same time of driving the air pump 31. An opening time duration t3 until the solenoid valves 32*a*, 32*b* are closed after they have been opened is set to be longer than the operation time duration t1 of the air pump 31 in the normal mode and shorter than a total time of the operation time duration t1 in the normal mode and the operation time duration t2 in the slow mode. The solenoid valves 32*a*, 32*b* are set so as to be repeatedly closed and opened after the opening time duration t3 has first passed. The solenoid valves 32*a*, 32*b* may be set so as to discharge the air in the air bags 21 at the same time of closing the solenoid valves 32*a*, 32*b* or so as to keep the air without discharging the air.

The described operation time duration t1 of the air pump 31 in the normal mode is set to enable the right shoulder air bag 21*a* and the left shoulder air bag 21*b* to be expanded until the user is put into the posture for just starting the treatment, that is, until the air bags 21*a*, 21*b* are expanded to a predetermined size (a predetermined expansion) in which the air bags 21*a*, 21*b* make contact with the human body with a certain level of pressure. The predetermined expansion varies depending on conditions such as the sizes of the air bags 21. A condition of the predetermined expansion may be appropriately set by the storage part 38 and the control part 36.

When the shoulder treatment operation is started, the control part 36 appropriately reads necessary information stored in the storage part 38 to enable the air pump 31 to drive in the normal mode. On the other hand, at the same time, the control part 36 outputs opening signals to the solenoid valves 32*a*, 32*b* to start to expand the right shoulder air bag 21*a* and the left shoulder air bag 21*b*. When a predetermined time passes after that, the control part 36 reads the electric input value information in the slow mode from the storage part 38 to output it into the air pump 31 and decrease the electric input value into the air pump 31 for shifting the air pump 31 into the slow mode.

The expansions of the right shoulder air bag 21*a* and the left shoulder air bag 21*b* are kept even after the air pump 31 shifts from the normal mode to the slow mode. Namely, as shown in FIG. 9, these expansions are performed with a normal speed until the air bags 21 are expanded to the predetermined expansion and then the air bags 21 are slowly expanded.

After that, the control part 36 opens and closes the solenoid valves 32*a*, 32*b* according to a predetermined mode to expand the air bags 21 in a phased manner or to repeatedly contract and expand the air bags 21. Since these expansions are performed in the slow mode, the treatment operation can be performed slowly and carefully as if the human body is pressed by human hands.

It is the same as the above-described case that the expansions until the air bags 21 are expanded to the predetermined expansion are not performed in a condition in which 85% of the air supply performance of the air pump 31 is provided, but such expansion is performed in the quick mode in which 100% of the air supply performance is provided as represented by an imaginary line (two-dot chain line) in FIG. 10 so that the air bags 21 are expanded more quickly than the normal mode.

<Example 5> The Case where an Expansion in the Normal Mode for One Air Bag is Started and then an Expansion in the Slow Mode for the Other Air Bag Related to the One Air Bag is Performed in One Treatment Operation in the Treatment Course The words of "the other air bag related to one air bag" used herein include the other air bag related to one air bag in the term that the one air bag and the other air bag press and grip the same part, the other air bag related to one air bag in the term that the one air bag and the other air bag perform treatment for the same purpose, the other air bag related to one air bag in the term that the one air bag and the other air bag perform the same treatment in cooperation with each other, the other air bag related to one air bag in the term that the other air bag utilizes the one air bag as means for fixing the human body for the purpose of treatment, that is as an actuator, and the like.

As one example, an example for performing treatment on the hip will be described.

Hip treatment is performed by simultaneously or alternately expanding and contracting the right hip air bag 21*e* and the left hip air bag 21*f*. At this time, the hip of the human body is fixed so as not to be moved by the right lateral waist air bag 21*h* and the left lateral waist air bag 21*i* to improve an effect of the treatment by the right hip air bag 21*e* and the left hip air bag 21*f*. Namely, the electric input value into the air pump 31 is sufficiently increased until the right lateral waist air bag 21*h* and the left lateral waist air bag 21*i*, which can be considered as one air bag 21, are expanded to a certain expanding condition and the electric input value into the air pump 31 is decreased behind the time when the electric input value has been sufficiently increased or after the time when the right lateral waist air bag 21*h* and the left lateral waist air bag 21*i* have been expanded to the certain expanding condition to elongate an air supply time duration for the right hip air bag 21*e* and the left hip air bag 21*f*, which can be considered as the other air bag 21 related to the right lateral waist air bag 21*h* and the left lateral waist air bag 21*i* for slowly expanding the right hip air bag 21*e* and the left hip air bag 21*f*.

The storage part 38 of the massager 11 stores electric input value information, timing information and time information for an operation in the normal mode in which the electric input value into the air pump 31 is sufficiently increased and an operation in the slow mode in which the electric input value into the air pump 31 is decreased so as to be lower than that of the normal mode as a hip treatment operation. Further, timing information for opening and closing the solenoid valves 32*h*, 32*i*, 32*e*, 32*f* respectively connected to the right lateral waist air bag 21*h*, the left lateral waist air bag 21*i*, the right hip air bag 21*e* and the left hip air bag 21*f* is stored so as to correspond to the timing information and the time information for the operation in each mode.

Figure 11:
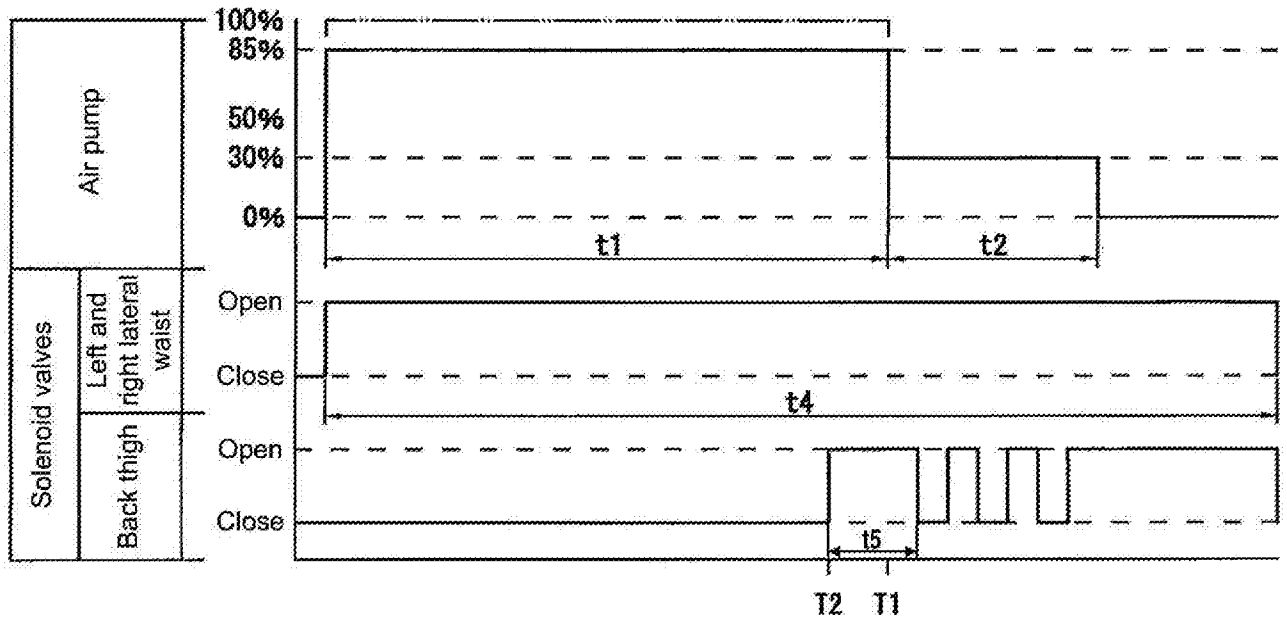
FIG. 11 is time charts for the air pump and the solenoid valves in a hip treatment operation in example 5.

Specifically, as shown in FIG. 11, the timing information is set so that the operation of the air pump 31 in the normal mode is performed for a time duration t1 and then the operation in the slow mode is performed for a time duration t2. This is one cycle.

Opening and closing timing and time for the solenoid valves 32*h*, 32*i* respectively connected to the right lateral waist air bag 21*h* and the left lateral waist air bag 21*i* are equal to each other. The solenoid valves 32*h*, 32*i* are opened at the same time of driving the air pump 31 before the solenoid valves 32*e*, 32*f* respectively connected to the right hip air bag 21*e* and the left hip air bag 21*f* are opened. An opening time duration t4 until the solenoid valves 32*h*, 32*i* are closed after they have been opened is set to be longer than a total time of the operation time duration t1 of the air pump 31 in the normal mode and the operation time duration t2 in the slow mode. An opening time duration for the solenoid valves 32*e*, 32*f* respectively connected to the right hip air bag 21*e* and the left hip air bag 21*f* are set so as to start at a time point T2 slightly before an operation shifting time point T1 when the operation time duration t1 of the air pump 31 in the normal mode ends.

The time point T2 is time when the right lateral waist air bag 21*h* and the left lateral waist air bag 21*i* are expanded to a certain level for allowing the human body to be fixed thereby. Further, the time point T2 is set so that the right hip air bag 21*e* and the left hip air bag 21*f* are brought into a condition before the treatment in which the right hip air bag 21*e* and the left hip air bag 21*f* make contact with the human body with a certain level of pressure at the time point T2.

The solenoid valves 32*e*, 32*f* respectively connected to the right hip air bag 21*e* and the left hip air bag 21*f* are set so as to be appropriately and repeatedly closed and opened after an opening time duration t5 beyond the operation shifting time point T1. The solenoid valves 32*e*, 32*f* may be set so as to discharge the air in the air bags 21 at the same time of closing the solenoid valves 32*e*, 32*f* or so as to keep the air without discharging the air.

As described above, the described operation time duration t1 of the air pump 31 in the normal mode is set to allow the lateral sides of the waist, that is the side part of the human body upper than the hip to be fixed. In other words, the operation time duration t1 of the air pump 31 in the normal mode is set to allow the right lateral waist air bag 21*h* and the left lateral waist air bag 21*i* to be expanded to a size for pressing the human body with a certain level of pressure. This expansion varies depending on conditions such as the sizes of the air bags 21. This predetermined expansion may be appropriately set by the storage part 38 and the control part 36.

When the hip treatment operation is started, the control part 36 appropriately reads necessary information stored in the storage part 38 to enable the air pump 31 to drive in the normal mode.

On the other hand, at the same time, the control part 36 outputs opening signals to the solenoid valves 32*h*, 32*i* respectively connected to the right lateral waist air bag 21*h* and the left lateral waist air bag 21*i* to start to expand the right lateral waist air bag 21*h* and the left lateral waist air bag 21*i*.

When a predetermined time passes after that, the control part 36 reads the electric input value information in the slow mode from the storage part 38 to output it into the air pump 31 and decrease the electric input value into the air pump 31 for shifting the air pump 31 into the slow mode.

The expansions of the right lateral waist air bag 21*h* and the left lateral waist air bag 21*i* are kept even after the air pump 31 shifts from the normal mode to the slow mode.

Namely, these expansions are performed with a normal speed until the air bags 21 are expanded to the predetermined expansion and then the air bags 21 are slowly expanded.

On the other hand, after the expansions of the right lateral waist air bag 21*h* and the left lateral waist air bag 21*i* are started for a while, the control part 36 outputs opening signals to the solenoid valves 32*e*, 32*f* respectively connected to the right hip air bag 21*e* and the left hip air bag 21*f* at the time point T2 slightly before the time point T1 when the air pump 31 shifts from the normal mode to the slow mode to start to expand the right hip air bag 21*e* and the left hip air bag 21*f*. The solenoid valves 32*e*, 32*f* respectively connected to the right hip air bag 21*e* and the left hip air bag 21*f* may be set so as to be opened at the same time or may be set so as to be opened at a different time.

Figure 12:
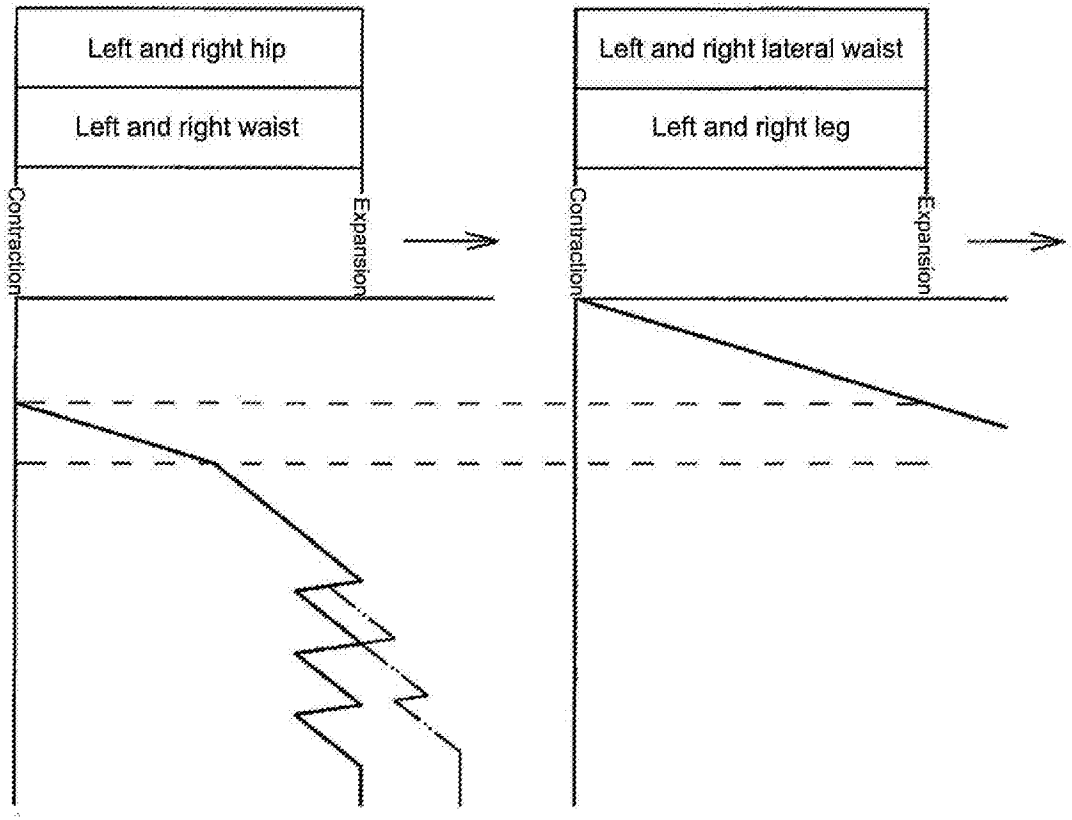
FIG. 12 is an explanatory drawing for illustrating expansion modes in the hip treatment operation and a waist stretching treatment operation.

After that, the control part 36 opens and closes the solenoid valves 32*e*, 32*f* respectively connected to the right hip air bag 21*e* and the left hip air bag 21*f* according to a predetermined mode to expand the air bags 21 in a phased manner (see an imaginary line in FIG. 12) or to repeatedly contract and expand the air bags 21 (see a solid line in FIG. 12). Since these expansions are performed in the slow mode, the treatment operation can be performed slowly and carefully as if the human body is pressed by human hands.

In the hip treatment operation as described above, the right lateral waist air bag 21*h* and the left lateral waist air bag 21*i* are quickly expanded before a stage when the treatment on the hip can be started, and then the subsequent treatment is slowly performed by the right hip air bag 21*e* and the left hip air bag 21*f*. Thus, it is possible to prevent the target part from being unnecessary moved, thereby efficiently performing the treatment on the hip. Although the air supply performance of the air pump 31 in the operation in the normal mode shown in FIG. 11 is set to be 85%, it may be possible to set the air supply performance of the air pump 31 to be 100% as represented by the imaginary line (two dot chain line) in FIG. 11 to perform the operation in the quick mode for expanding the air bags 21 more quickly than the operation in the normal mode.

In addition to the effect that it is possible to efficiently perform the treatment, it is possible to perform the hip treatment operation slowly and carefully as if the human body is massaged by human hands. Thus, it is possible to perform a variety of treatment.

The hip treatment operation as described above is set so as to be incorporated into a treatment course or be singularly utilized.

Next, description will be given to an example of a waist stretch.

The waist stretch is a stretch for stretching the waist. In the waist stretch, the backrest part 12 of the massager 11 is reclined toward the rear side as represented by an imaginary line (two dot chain line) in FIG. 2 and the ottoman 16 is rotated toward the lower side in a state that the legs have been gripped by the left and right leg air bags 21*m* of the ottoman 16, which has been rotated so that the lower end of the ottoman 16 is lifted up, to perform an operation for stretching the legs to the front side and pulling the legs toward the lower side for stretching the entire human body. Further, the right waist air bag 21*c*, the left waist air bag 21*d*, the right hip air bag 21*e* and the left hip air bag 21*f* are expanded to lift up the hip for stretching the waist. This treatment operation is performed not only by the air bags 21 but also in cooperation with the backrest pivot actuator 34 and the ottoman pivot actuator 35.

Namely, the electric input value into the air pump 31 is sufficiently increased until the left and right leg air bags 21*m*, which can be considered as one air bag 21, are expanded to a certain expanding condition and the electric input value into the air pump 31 are decreased for elongating air supply times for the right waist air bag 21*c*, the left waist air bag 21*d*, the right hip air bag 21*e* and the left hip air bag 21*f*, which can be considered as the other air bag 21 related to the left and right leg air bags 21*m*, to slowly expand the right waist air bag 21*c*, the left waist air bag 21*d*, the right hip air bag 21*e* and the left hip air bag 21*f* behind the time when the electric input value has been sufficiently increased or after the time when the left and right leg air bags 21*m* have been expanded to the certain expanding condition.

The storage part 38 of the massager 11 stores electric input value information, timing information and time information for an operation in the normal mode in which the electric input value into the air pump 31 is sufficiently increased and an operation in the slow mode in which the electric input value into the air pump 31 is decreased so as to be lower than that of the normal mode as a waist stretching operation. Further, timing information for opening and closing the solenoid valve 32*m* connected to the left and right leg air bags 21*m* and the solenoid valves 32*e*, 32*f* respectively connected to the right hip air bag 21*e* and the left hip air bag 21*f*, driving timing information and time information for driving the backrest pivot actuator 34 and the ottoman pivot actuator 35 are stored so as to correspond to the timing information and the time information for the operation in each mode.

Figure 13:
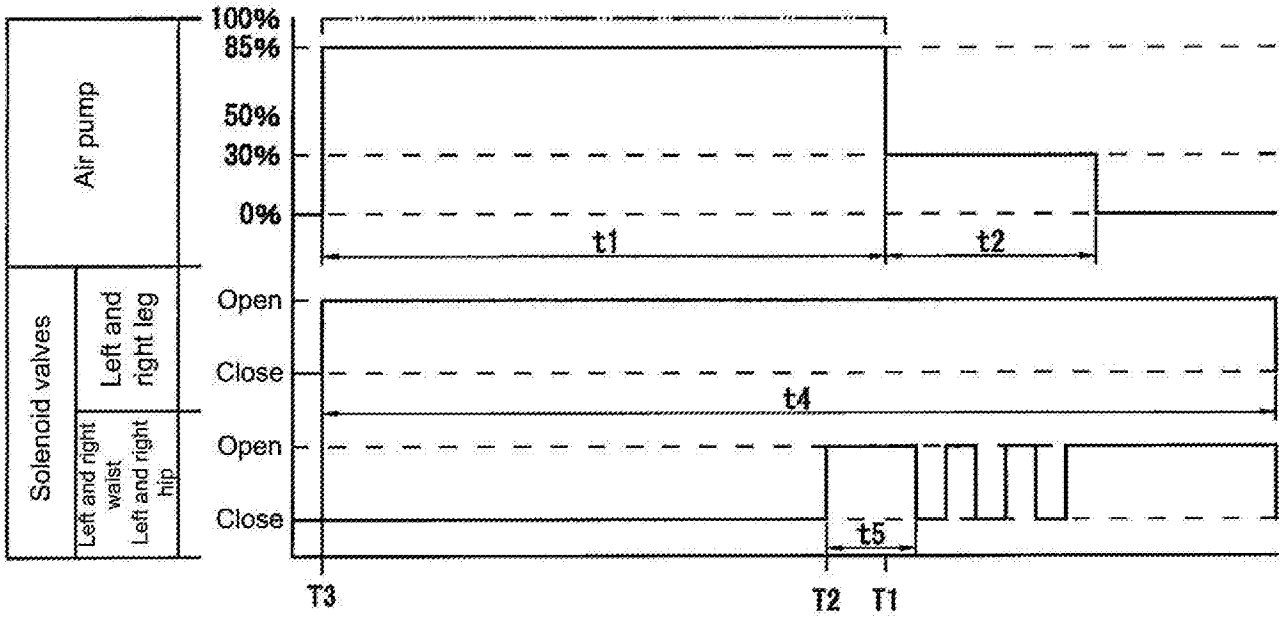
FIG. 13 is time charts for the air pump and the solenoid valves in the waist stretching treatment operation in example 5.

Specifically, as shown in FIG. 13, the timing information is set so that the operation of the air pump 31 in the normal mode is performed for a time duration t1 and then the operation in the slow mode is performed for a time duration t2. This is one cycle.

Opening and closing timing for the solenoid valve 32*m* connected to the left and right leg air bags 21*m* is set so that the solenoid valve 32*m* is opened at the same time of driving the air pump 31 before the solenoid valves 32*c*, 32*d*, 32*e*, 32*f* respectively connected to the right waist air bag 21*c*, the left waist air bag 21*d*, the right hip air bag 21*e* and the left hip air bag 21*f* are opened.

An opening time duration t4 until the solenoid valve 32*m* is closed after the solenoid valve 32*m* has been opened is set to be longer than a total time of the operation time duration t1 of the air pump 31 in the normal mode and the operation time duration t2 in the slow mode.

An opening time duration for the solenoid valves 32*c*, 32*d*, 32*e*, 32*f* respectively connected to the right waist air bag 21*c*, the left waist air bag 21*d*, the right hip air bag 21*e* and the left hip air bag 21*f* are set so as to start at a time point T2 slightly before an operation shifting time point T1 when the operation time duration t1 of the air pump 31 in the normal mode ends.

The time point T2 is time when the left and right leg air bags 21*m* are expanded to a certain level for allowing the legs of the human body to be fixed thereby. Further, the time point T2 is set so that the right waist air bag 21*c*, the left waist air bag 21*d*, the right hip air bag 21*e* and the left hip air bag 21*f* are brought into a condition before the lifting-up treatment in which the right waist air bag 21*c*, the left waist air bag 21*d*, the right hip air bag 21*e* and the left hip air bag 21*f* make contact with the human body with a certain level of pressure at the time point T2.

The solenoid valves 32*c*, 32*d*, 32*e*, 32*f* respectively connected to the right waist air bag 21*c*, the left waist air bag 21*d*, the right hip air bag 21*e* and the left hip air bag 21*f* are set so as to be repeatedly closed and opened after an opening time duration t5 beyond the operation shifting time point T1. The solenoid valves 32*c*, 32*d*, 32*e*, 32*f* may be set so as to discharge the air in the air bags 21 at the same time of closing the solenoid valves 32*c*, 32*d*, 32*e*, 32*f* or so as to keep the air without discharging the air.

As described above, the described operation time duration t1 of the air pump 31 in the normal mode is set to enable the left and right leg air bags 21*m* to be expanded to a size for gripping the legs of the human body with a certain level of pressure to fix the legs of the human body. This expansion varies depending on conditions such as the sizes of the air bags 21. This predetermined expansion may be appropriately set by the storage part 38 and the control part 36.

The backrest pivot actuator 34 is set so that the backrest pivot actuator 34 is driven before the air pump 31 starts to drive and before a time point T3 when the solenoid valve 32*m* connected to the left and right leg air bags 21*m* is opened. Further, the backrest pivot actuator 34 is set so that the driving of the backrest pivot actuator 34 stops at the time point T3 in a state that the backrest part 12 is reclined toward the rear side. In the same manner, the ottoman pivot actuator 35 is set so that the ottoman pivot actuator 35 is driven before the time point T3 and the driving of the ottoman pivot actuator 35 stops at the time point T3 in a state that the ottoman 16 is lifted up and positioned in a substantially horizontal posture in the same manner as the backrest part 12. Further, the ottoman pivot actuator 35 is set so as to be pivotally moved toward the lower side after the left and right leg air bags 21*m* grip the legs, that is after the operation shifting time point T1.

When the waist stretching treatment operation is started, the control part 36 appropriately reads necessary information stored in the storage part 38 to drive the backrest pivot actuator 34 and the ottoman pivot actuator 35 to recline the backrest part 12 toward the rear side and rotate the ottoman 16 toward the upper side for changing a form of the massager 11 into a bed-like form. After that, the control part 36 enables the air pump 31 to drive in the normal mode.

On the other hand, at the same time, the control part 36 outputs an opening signal to the solenoid valve 32 connected to the left and right leg air bags 21*m* to start to expand two pairs of the left and right leg air bags 21*m*. When a predetermined time passes after that, the control part 36 reads the electric input value information in the slow mode from the storage part 38 to output it into the air pump 31 and decrease the electric input value into the air pump 31 for shifting the air pump 31 into the slow mode.

The expansions of the two pairs of the left and right leg air bags 21*m* are kept even after the air pump 31 shifts from the normal mode to the slow mode. Namely, these expansions are performed with a normal speed until the air bags 21 are expanded to the predetermined expansion and then the air bags 21 are slowly expanded.

On the other hand, after the expansions of the two pairs of the left and right leg air bags 21*m* are started for a while, the control part 36 drives the ottoman pivot actuator 35 to rotate the ottoman 16 toward the lower side at the time point T2 before the time point T1 when the air pump 31 shifts from the normal mode to the slow mode. At the same time or behind that, the control part 36 outputs opening signals to the solenoid valves 32*c*, 32*d*, 32*e*, 32*f* respectively connected to the right waist air bag 21*c*, the left waist air bag 21*d*, the right hip air bag 21*e* and the left hip air bag 21*f* to start to expand the right waist air bag 21*c*, the left waist air bag 21*d*, the right hip air bag 21*e* and the left hip air bag 21*f*. All of the solenoid valves 32*c*, 32*d*, 32*e*, 32*f* respectively connected to the right waist air bag 21*c*, the left waist air bag 21*d*, the right hip air bag 21*e* and the left hip air bag 21*f* are opened at the same time.

After that, the control part 36 opens and closes the solenoid valves 32*c*, 32*d*, 32*e*, 32*f* respectively connected to the right waist air bag 21*c*, the left waist air bag 21*d*, the right hip air bag 21*e* and the left hip air bag 21*f* according to a predetermined mode to expand the air bags 21 in a phased manner (see the imaginary line (two dot chain line) in FIG. 12) or to repeatedly contract and expand the air bags 21 (see the solid line in FIG. 12). Since these expansions are performed in the slow mode, the treatment operation can be performed slowly and carefully as if the human body is pressed by human hands.

In the waist stretching treatment operation as described above, the left and right leg air bags 21*m* are quickly expanded before a stage when the stretch on the hip can be started to perform the stretch in a state that the legs are strongly fixed, and the subsequent stretch is slowly performed by lifting up the waist and the hip of the human body due to the expansions of the right waist air bag 21*c*, the left waist air bag 21*d*, the right hip air bag 21*e* and the left hip air bag 21*f*. Thus, it is possible to effectively perform the waist stretch. Although the air supply performance of the air pump 31 in the operation in the normal mode shown in FIG. 13 is set to be 85%, it may be possible to set the air supply performance of the air pump 31 to be 100% as represented by the imaginary line (two dot chain line) in FIG. 13 to perform the operation in the quick mode for expanding the air bags 21 more quickly than the operation in the normal mode.

The waist stretching treatment operation as described above is set so as to be incorporated into a treatment course or be singularly utilized.

In the description for "the example 5", examples of "the other air bag related to one air bag" described above include the other air bag related to one air bag in the term that the one air bag and the other air bag perform treatment for the same purpose, the other air bag related to one air bag in the term that the one air bag and the other air bag perform the same treatment in cooperation with each other, the other air bag related to one air bag in the term that the other air bag utilizes the one air bag as means for fixing the human body for the purpose of treatment, that is as an actuator, and the like.

Example of "the other air bag related to one air bag" in the term that the one air bag and the other air bag press and grip the same part includes the cases shown in FIG. 14 and FIGS. 15A-15C where a plurality of air bags having independent air rooms are overlapped with each other.

Figure 14:
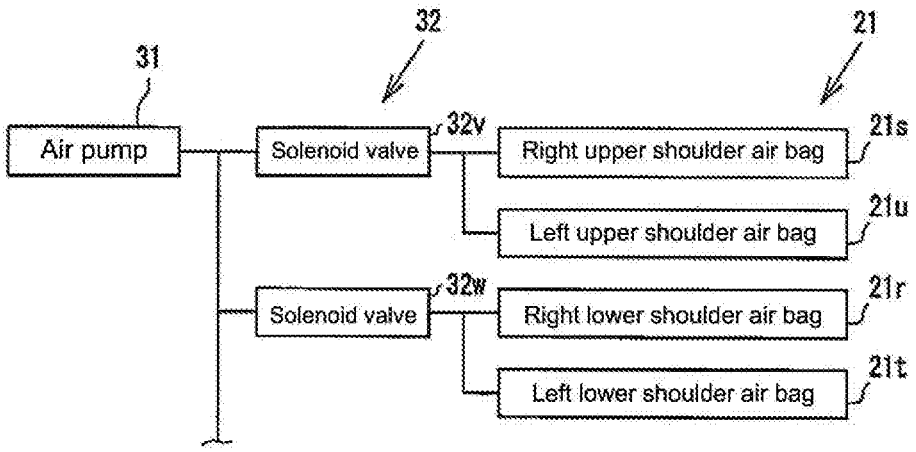
FIG. 14 is an air circuit block diagram from the air pump to the air bags according to other examples in the example 5.
Figure 15A:
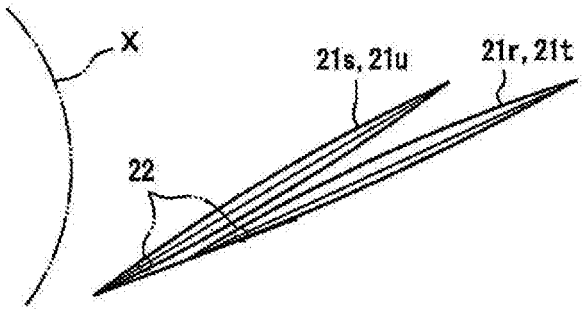
FIGS. 15A through 15C are the operation explanatory drawing of the air bags according to the other examples in the example 5.
Figure 15B:
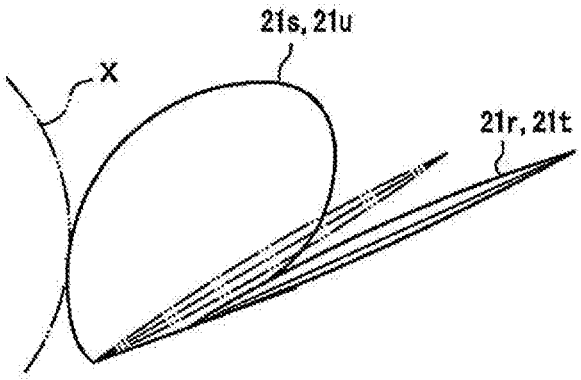
Figure 15C:
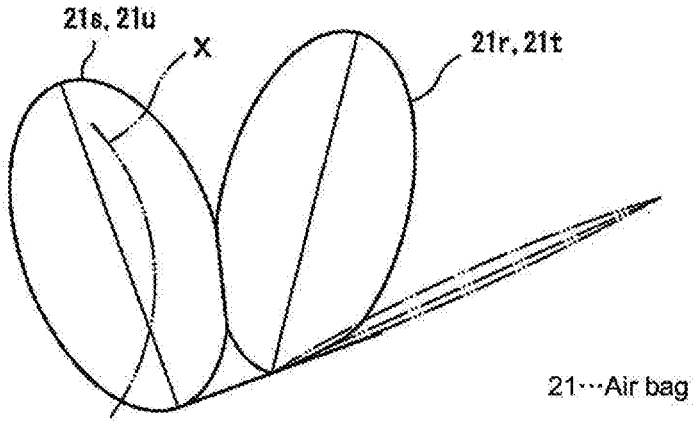

FIG. 14 and FIGS. 15A-15C show examples of the air bags 21 for performing the treatment on the shoulders. For the purpose of illustration, only a part corresponding to one shoulder is illustrated in FIGS. 15A-15C. In FIGS. 15A-15C, the character "X" represents the shoulder. Further, in this example, an example in which two air bags 21 are overlapped with each other for one shoulder is illustrated. Namely, a right shoulder air bag is constituted of a right lower shoulder air bag 21*r* and a right upper shoulder air bag 21*s* and a left shoulder air bag is constituted of a left lower shoulder air bag 21*t* and a left upper shoulder air bag 21*u*. The number of the air bags of the right shoulder air bag or the left shoulder air bag is not limited to only two, but may be three, four or the like.

An air supply port 22 is formed for each air bag 21 and the air rooms of the air bags 21 are independent from each other. Each of the air bags 21 is supported so that each of the air bags 21 can be pivotally moved around a lower part thereof. In a contracted condition, the air bags 21 are overlapped with each other as shown in FIG. 15A.

Each of the air bags 21 (the right lower shoulder air bag 21*r*, the right upper shoulder air bag 21*s*, the left lower shoulder air bag 21*t* and the left upper shoulder air bag 21*u*) is connected to the air pump 31 through the solenoid valve 32*v* or 32*w* as shown in FIG. 14. Namely, the right upper shoulder air bag 21*s* and the left upper shoulder air bag 21*u* are connected to the air pump 31 through the solenoid valve 32*v* and the right lower shoulder air bag 21*r* and the left lower shoulder air bag 21*t* are connected to the air pump 31 through the solenoid valve 32*w*.

The storage part 38 of the massager 11 stores electric input value information, timing information and time information for an operation in the normal mode in which the electric input value into the air pump 31 is sufficiently increased and an operation in the slow mode in which the electric input value into the air pump 31 is decreased so as to be lower than that of the normal mode as a shoulder treatment operation. Further, timing information for opening and closing the solenoid valves 32*v*, 32*w* connected to the left and right leg air bags 21*m* and the solenoid valves 32*e*, 32*f* connected to the right upper shoulder air bag 21*s*, the left upper shoulder air bag 21*u*, the right lower shoulder air bag 21*r* and the left lower shoulder air bag 21*t* so as to correspond to the timing information and the time information for the operation in each mode.

Specifically, in the same manner as the example shown in FIG. 10, the timing information for the air pump 31 is set so that the operation of the air pump 31 in the normal mode is performed for a certain time duration and then the operation in the slow mode is performed for a certain time duration. The timing information for the air bags 21 is set so that the solenoid valve 32*v* connected to the right upper shoulder air bag 21*s* and the left upper shoulder air bag 21*u* is opened before the solenoid valve 32*w* connected to the right lower shoulder air bag 21*r* and the left lower shoulder air bag 21*t* is opened.

In the shoulder treatment operation, the right upper shoulder air bag 21*s* and the left upper shoulder air bag 21*u* are expanded in the normal mode or the quick mode before the right lower shoulder air bag 21*r* and the left lower shoulder air bag 21*t*. Further, the right lower shoulder air bag 21*r* and the left lower shoulder air bag 21*t* are expanded in the slow mode after the right upper shoulder air bag 21*s* and the left upper shoulder air bag 21*u* have been expanded to a predetermined expanding condition in order to perform the treatment.

Namely, when the shoulder treatment operation is started, the control part 36 first opens the solenoid valve 32*v* connected to the right upper shoulder air bag 21*s* and the left upper shoulder air bag 21*u* to start to expand the right upper shoulder air bag 21*s* and the left upper shoulder air bag 21*u*. In the same manner as the example shown in FIG. 10, an expanding time duration is stored as information for expanding the right upper shoulder air bag 21*s* and the left upper shoulder air bag 21*u* to a posture just before the treatment is performed to the human body, that is information for expanding the right upper shoulder air bag 21*s* and the left upper shoulder air bag 21*u* to a predetermined size (predetermined expansion) in which the right upper shoulder air bag 21*s* and the left upper shoulder air bag 21*u* make contact with the human body with a certain level of pressure. The predetermined expansion as shown in FIG. 15B varies depending on conditions such as the sizes of the air bags 21. The predetermined expansion may be an expansion limit of the air bags 21 (the right upper shoulder air bag 21*s* and the left upper shoulder air bag 21*u*). The predetermined expansion may be appropriately set by the storage part 38 and the control part 36.

After the right upper shoulder air bag 21*s* and the left upper shoulder air bag 21*u* have been expanded to the predetermined expanding condition, the control part 36 decreases the electric input value into the air pump 31 to shift the air pump 31 to the slow mode and opens the solenoid valve 32*w* connected to the right lower shoulder air bag 21*r* and the left lower shoulder air bag 21*t* for a predetermined time duration. With this configuration, the right lower shoulder air bag 21*r* and the left lower shoulder air bag 21*t* are slowly expanded. In the same manner as the example shown in FIG. 10, the control part 36 reads the data stored in the storage part 38 and appropriately and repeatedly opens and closes the solenoid valve 32*w* connected to the right lower shoulder air bag 21*r* and the left lower shoulder air bag 21*t* after a predetermined opening time for the solenoid valve 32*w* passes. This makes it possible to expand the right lower shoulder air bag 21*r* and the left lower shoulder air bag 21*t* in a phased manner or repeatedly contract and expand the right lower shoulder air bag 21*r* and the left lower shoulder air bag 21*t*. With this configuration, it is possible to indirectly press the human body through the right upper shoulder air bag 21*s* and the left upper shoulder air bag 21*u*. Since the expansions in this time are performed in the slow mode, the treatment operation can be performed slowly and carefully as if the human body is pressed by human hands.

In addition, parts contacting with the shoulders of the human body are expanded so as to have a certain level of hardness at a time point when the treatment is actually performed and the stimulation is changed mainly by the expansions of the right lower shoulder air bag 21*r* and the left lower shoulder air bag 21*t*. Thus, it is possible to give the user new treatment feeling.

In the case where it is desired to give the user treatment feeling as the conventional art, the right upper shoulder air bag 21*s* and the left upper shoulder air bag 21*u* may be expanded after the right lower shoulder air bag 21*r* and the left lower shoulder air bag 21*t* have been expanded.

The above treatment operation in each example is merely one example, and it is possible to take other aspects. Further, it is possible to perform the treatment by appropriately combining the treatment operations as described in the above examples.

As described in the examples, the massager 11 can perform the variety of treatment and successfully perform the treatment flexibly corresponding to different purposes and/or situations. In addition, since the number of the air pumps 31 required for this purpose is at least one, there are advantages of downsizing and/or energy-saving and suppressing the increase of a manufacturing cost thereof.

In correspondence between the configuration of the present invention and the described configuration, an air massage device of the present invention corresponds to the described chair type massager 11. In the same manner, an air supply valve of the present invention corresponds to the solenoid valve 32. However, the present invention is not limited to only the described configuration, thus it is possible to take another configuration.

A main object of the embodiment of the present invention is to enable a variety of treatment to be performed without providing a plurality of air pumps.

Means for achieving the above object is an air massage device including a plurality of air bags; an air pump for supplying air into each of the air bags; air supply valves for switching on-off of air supply into each of the air bags; and a control part for changing an amount of the supplied air into each of the air bags per unit time according to an electric input value into the air pump to open and close each of the air supply valves so as to correspond to the amount of the supplied air.

In this configuration, when the control part changes the electric input value into the air pump, that is voltage or current based on a predetermined program or an instruction inputted while an operation is performed, the amount of the supplied air into each of the air bags per unit time decreases or increases.

Responding to this change of the amount of the supplied air, the control part opens and closes the air supply valves according to the predetermined program to expand necessary air bags in a desired mode. Namely, the air bags are expanded with spending a long time or a short time.

The change of the amount of the supplied air can be performed for each treatment course or in the treatment course. Further, it is possible to allow the change of the amount of the supplied air to be in conjunction with a mechanical unit such as a massaging ball or other mechanisms such as a backrest pivot actuator and an ottoman pivot actuator.

According to the embodiment of the present invention, it is possible to perform a variety of treatment without providing a plurality of air pumps having different air supply performances. In addition, it is possible to perform a more variety of treatment than a case of providing the plurality of air pumps.

What is claimed is:

1. An air massage chair device, comprising:

a plurality of air bags, wherein each airbag comprises a plurality of airbag carriers overlapped and integrally connected with one another forming one internal air room communication;

an air pump for supplying air into each airbag of the plurality of air bags;

a plurality of air supply valves for switching on-off of air supply into each of the air bags;

a storage part for storing an electric input value sent to the air pump and an opening and closing timing for each of the air supply valves; and a control part for controlling an amount of the supplied air into each of the airbags per unit time according to the electric input value, and for repeatedly opening and closing the air supply valves which correspond to the each of the airbags at the opening and closing timing stored in the storage part, and opening and closing of each of the air supply valves depends on the amount of the supplied air into each of the air bags;

wherein at a first predetermined electric input value of the air pump, the air pump is configured to provide a maximum amount of air supply into each of the airbags and at a second predetermined electric input value of the air pump, the air pump is configured to provide less amount of air supply than said maximum amount of air supply, wherein said first predetermined electric input value of the air pump is greater than said second predetermined electric input value of the air pump;

wherein at a first step of expansion, said each of the airbags are expanded to a first predetermined level with said maximum amount of air supply at a first expansion rate, and at a second step of expansion, said each of the airbags are expanded to a second predetermined level with said less amount of air supply than said maximum amount of air supply at a second expansion rate;

wherein said second expansion rate is slower than said first expansion rate;

wherein the control part enables the electric input value to be set and each of the air supply valves to be opened and closed based on a plurality of predetermined treatment courses;

wherein during treatment operations in one treatment course among the plurality of predetermined treatment courses, the control part, in a first stage, opens the air supply valve corresponding to at least one airbag of the plurality of air bags and sets the electric input value to a high electric value until the at least one air bag is expanded to a certain expanding condition, and the control part, in a second stage, changes the electric input value from the high electrical input value to a low electric input level and repeatedly opens and closes the air supply valves at the opening and closing timing stored in the storage part.

2. The air massage chair device according to claim 1, wherein the first stage and the second stage of the treatment operations are alternately repeated for at least one airbag on a right side and at least one airbag on a left side of a human body to be treated.

3. The air massage chair device according to claim 1, wherein the air supply valves corresponding to the plurality of air bags are opened in the first stage, an air supply valve corresponding to a first pair of air bags of the plurality of air bags is opened after the time when a second pair of air bags of the plurality of air bags has been expanded to a certain expanding condition.

4. The air massage chair device according to claim 1, wherein said air massage chair device further comprising a backrest part, two airbags of the plurality of air bags are arranged to be overlapped with each other between a human body to be treated and the backrest part of the air massage chair device;

wherein the control part opens an air supply valve of the plurality of air supply valves corresponding to an air bag of the two air bags in the first stage, and the control part repeatedly opens and closes an air supply valve of the plurality of air valves corresponding to a second air bag of the two air bags on a side of the backrest part of the air massage chair device in the second stage.

5. The air massage chair device according to claim 1, wherein the control part enables the air massage chair device to perform treatment operations due to one treatment course in which the electric input value into the air pump is set to the high electrical input level in addition to treatment operations due to a second treatment course in which the electric input value is set to the low electrical input value to elongate an air supply time duration.

* * * * *